United States Patent [19]

Dodge et al.

[11] 4,138,758

[45] Feb. 13, 1979

[54] CHIMNEY CLEANING SYSTEM AND CHIMNEY CLEANING ELEMENT

[76] Inventors: Walton L. Dodge; Wayne T. Dodge, both of Dodge Rd., North Edgecombe, Me. 04556

[21] Appl. No.: 824,648

[22] Filed: Aug. 15, 1977

[51] Int. Cl.[2] ..... F23J 3/00

[52] U.S. Cl. ..... 15/243

[58] Field of Search ..... 15/163, 243

[56] References Cited

U.S. PATENT DOCUMENTS

| | | | |
|---|---|---|---|
| 1,297,090 | 3/1919 | Campbell et al. | 15/163 |
| 2,284,391 | 5/1942 | Hefle | 15/163 |

FOREIGN PATENT DOCUMENTS

| | | | |
|---|---|---|---|
| 2155733 | 5/1973 | Fed. Rep. of Germany | 15/243 |

*Primary Examiner*—Edward L. Roberts

[57] ABSTRACT

A permanently emplaceable chimney cleaning system is provided with a removable cleaning element which is flexible as to shape and dimension.

2 Claims, 5 Drawing Figures

FIG.1
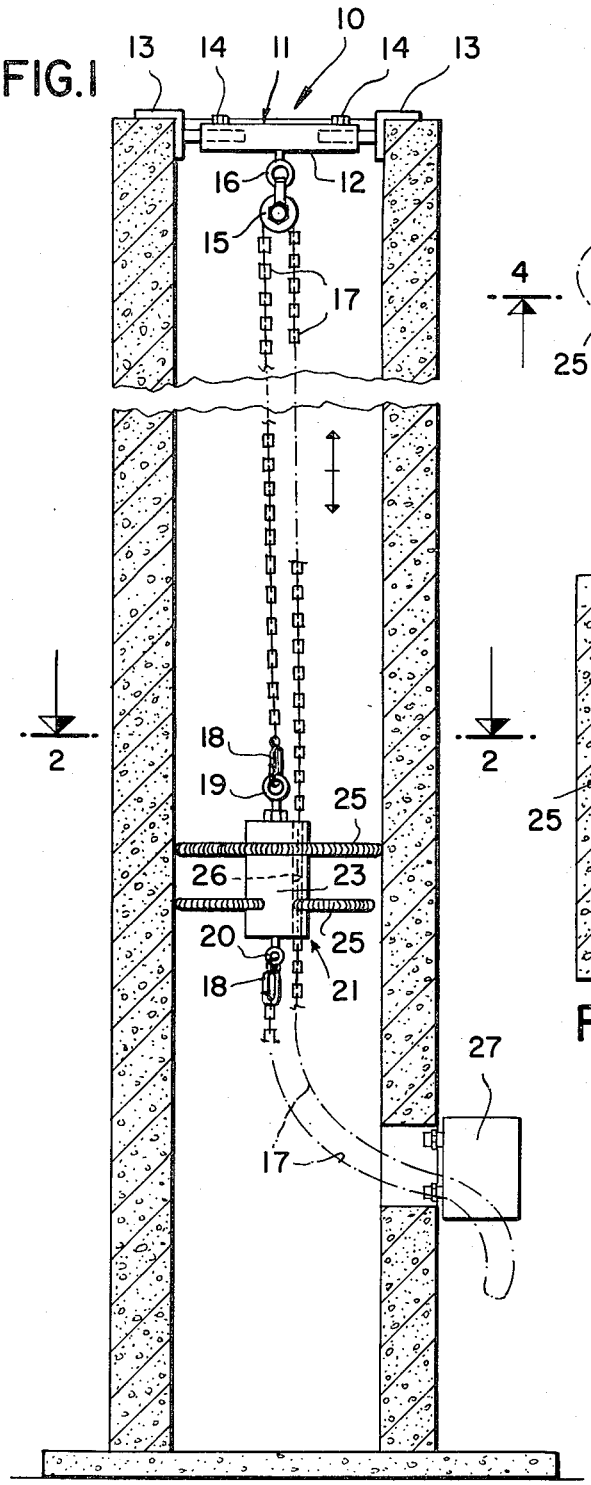
FIG.3
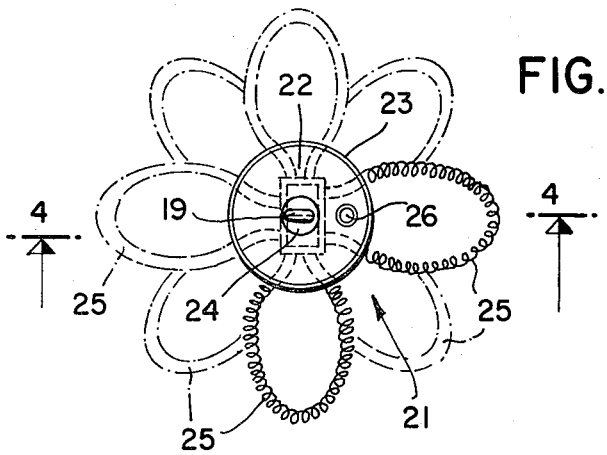
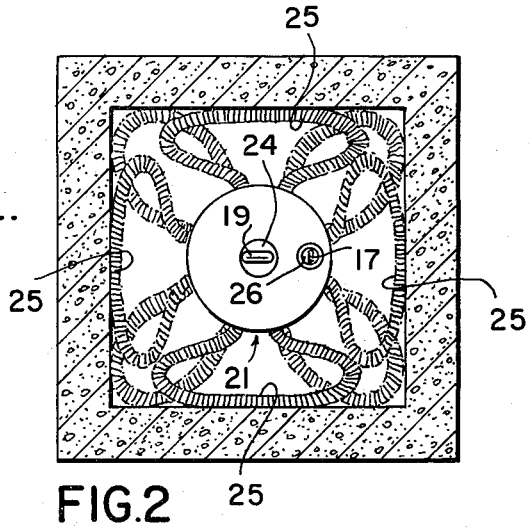
FIG.2
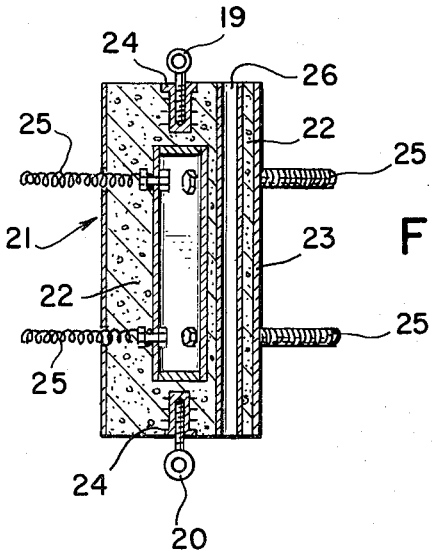
FIG.4
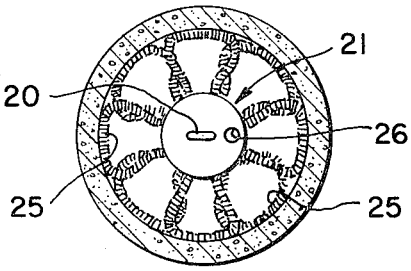
FIG.5

CHIMNEY CLEANING SYSTEM AND CHIMNEY CLEANING ELEMENT

The present invention relates to an improved chimney cleaning system and chimney cleaning element.

Since the resurgence of wood-burning stoves relying on a renewable energy source, the need to have clean chimneys has again become important. The wood-burning stove by its nature radiates a large portion of its heat and burns, leaving residues.

The conventional fireplace emits much of its heat up the flue and thereby deposits less residues which are likely to pose a fire hazard than the flue of a wood-burning stove. The flue of a wood-burning stove must be cleaned more frequently to avoid fire hazards.

Having a permanent installation from which a chimney flue may be cleaned from inside the house is particularly desirable with the necessary more frequent cleaning required of a wood-burning chimney flue.

Permanent installation for chimney cleaning have been known in the past, including many operable from inside the house. One problem of such installation has been their complexity and the difficulty encountered by the sticking of the cleaning element. Further, the cleaning elements of the past generally had to be custom fitted to the chimney.

Variable size cleaning elements were often very limited in their ability to vary limited as to shape variation and distinguished from dimension variation, limited as to dimension variation and complicated and expensive. Bristle devices of the past, while somewhat adaptable as to shape and dimension, tended to get stuck in use. The other complex systems' cleaning elements tended to jam or their cleaning devices tended to get stuck quite often. Bristle devices of the past usually could not be fitted through the normal chimney clean-out door.

According to the present invention a permanently emplacable chimney cleaning system is provided with a removable cleaning element that is flexible as to shape and dimension, an effective flue cleaner and not likely to get stuck in a flue when in use.

The cleaning device of the present invention may be removed and stored or used in connection with more than one permanent emplacement.

Once installed, the cleaning system may be operated from inside the house through a chimney clean-out door, even on capped chimneys and even while a flue is in use. The cleaning device of the present invention is introduced from the bottom of the flue.

Although such novel feature or features believed to be characteristic of the invention are pointed out in the claims, the invention and the manner in which it may be carried out, may be further understood by reference to the description following and the accompanying drawings.

FIG. 1 is a vertical section of a flue including the chimney cleaning system of the present invention.

FIG. 2 is a section of FIG. 1 at lines 2—2.

FIG. 3 is a plan view of a chimney cleaning element of the present invention.

FIG. 4 is a section of the element of FIG. 3 at lines 4—4.

FIG. 5 is a plan view of a cleaning element of the present invention in a circular flue.

Referring now to the figures in greater detail, where like reference numbers denote like parts in the various figures.

The chimney cleaning system 10 as shown in FIG. 1 comprises a chimney bracket 11 which is preferably expandable to fit a selection of chimneys. The bracket 11 has a main bar 12, a pair of angle irons 13, slidably attached in channels (not shown) in the bracket 11. The angle irons 13 are settable against the sides of the chimney and lockable in position by setting bolts 14.

A pulley 15 hangs from a ring 16, depending from the bracket 11. A chain 17 is threaded through the pulley 15. Each end of the chain includes a spring fastener 18. The spring fasteners are attachable to the rings in eyebolts 19, 20 in the cleaning element 21.

The cleaning element 21 has a central weighted body 22 inside a metal tube 23. There are anchors 24 at either end to receive the eyebolts 19, 20.

The cleaning element 21 includes a plurality of coil springs 25, preferably anchored or bolted into the weighted body 22, spaced apart at two levels. As shown, four coil springs 25 are diametrically apposed on one level and four more, offset between the upper level, are diametrically opposed. A channel 26 is longitudinally passed through the weighted body 22 and is adapted to allow the chain 17 to pass through.

In use, the chimney bracket 11 is usually permanently set with the angle irons 13 braced against the sides of the chimney and held in position by the bolts 14. The pulley 15 is hung from the ring 16 with the chain 17 threaded through the pulley 15.

One end of the chain 17, with its spring fastener 18, is snapped onto the ring 19 anchored in the weighted body 22 of the cleaning element 21. The chain 17 is threaded through the channel 26 in the weighted body 22, then the spring fastener 18 at the other end of the chain 17 is snapped onto the ring 20 in the weighted body 22. The attachment of the cleaning element 21 may be taken care of outside the clean-out door 27. The cleaning element 21 may be pushed through the clean-out door 27. The spaced coil springs 25 easily yield to allow admission of the cleaning element 21 through the clean-out door 27.

Once inside the chimney, the cleaning element 21 is pulled up the chimney by hauling in on the chain 17. The cleaning element 21 may then be dropped or pulled downward to clean the sides of the chimney.

Particularly because the channel 26 is off center of the weighted body 22, the engaged chain 17 may be twisted in order to rotate the cleaning element 21 inside the chimney where desired.

The looped configuration of the coil openings 25 in their staggered relationship usually provides an overlapping of surface coverage inside a chimney for effective cleaning. The coil springs 25 of about thirteen inches or so loop from the cleaning element 21 compress and form against the sides of a chimney. As can be seen in FIG. 2, the coil springs 25 substantially conform to the contours of a round chimney. The cleaning element 21 will work in a selection of different chimney dimensions as well as in a tapered chimney.

The cleaning element 21, once inside the chimney, may be raised and dropped for cleaning or pulled up and down by manipulation of the claim 17.

After use, the cleaning element 21 may be left inside the chimney or taken out through the clean-out door 27. When the cleaning element 21 is taken out and removed, it is advisable to connect the spring fasteners 18 to each other so that the chain 17 does not disengage from the pully 15.

The cleaning element 21 may be used in conjunction with more than one installed system 10, installed with just the chimney bracket 11 and its assembly and the chain 17.

In a preferred embodiment, a 3" × 4½" length of galvanized drainpipe may be used as the metal tube 23 of the cleaning element 21. Sets of spaced holes are set in the metal tube 23 to receive the ends of the coil springs 25. The anchors 24 and a half inch channel 26 and springs 25 are placed in position in the metal tube 23 which is then filled with mortar to solidify integrating the elements of the cleaning element 21. The springs 25 may be held inside the weighted body 22 as shown in FIG. 4.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. In a chimney cleaning system including a support emplaced in a chimney, a pulley, said pulley depending from said support, line means running over said pulley, said line means having two ends, a chimney cleaning element including a weighted body portion, said weighted body portion including a ring at each opposite longitudinal end of said rigid body portion, each said ring centered in said weighted body portion, a longitudinal channel through said weighted body portion, said longitudinal channel eccentric in said weighted body portion, said channel adapted to pass said line therethrough, a plurality of coil springs extending from said weighted body portion in the form of loops, and one end of said line attached to one said ring, said line passing through said channel, said other end of said line attached to the other of said rings.

2. The invention as claimed in claim 1 including two sets of coil springs spaced apart from each other longitudinally along said body portion; said coil spring sets offset from each other.

* * * * *